US007378379B2

(12) United States Patent
Sivik et al.

(10) Patent No.: US 7,378,379 B2
(45) Date of Patent: May 27, 2008

(54) FUNCTIONALIZED POLYMER COMPOSITION FOR GREASE

(75) Inventors: Matthew R. Sivik, Broadview Hts., OH (US); Mohamed G. Fahmy, Eastlake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 688 days.

(21) Appl. No.: 10/458,505

(22) Filed: Jun. 10, 2003

(65) Prior Publication Data

US 2004/0254080 A1 Dec. 16, 2004

(51) Int. Cl.
*C10M 169/06* (2006.01)
*C10M 145/10* (2006.01)

(52) U.S. Cl. ..... 508/136; 508/467; 508/469; 508/539

(58) Field of Classification Search ..... 508/232, 508/467, 469, 470, 136
See application file for complete search history.

(56) References Cited

U.S. PATENT DOCUMENTS 4,668,412 A 5/1987 Hart et al. ..... 252/51.5 A
4,822,508 A * 4/1989 Pennewiss et al. ..... 508/264
4,867,894 A * 9/1989 Pennewiss et al. ..... 508/470
4,929,371 A 5/1990 Waynick ..... 252/25
4,968,444 A * 11/1990 Knoell et al. ..... 508/262
5,000,862 A 3/1991 Waynick ..... 252/11
5,116,522 A * 5/1992 Brown et al. ..... 508/473
5,188,770 A * 2/1993 Pennewiss ..... 508/471
5,368,761 A * 11/1994 Gore et al. ..... 508/469
5,721,201 A * 2/1998 Tomassen et al. ..... 508/469
5,955,405 A * 9/1999 Liesen et al. ..... 508/469
6,124,249 A * 9/2000 Seebauer et al. ..... 508/469
6,255,261 B1 * 7/2001 Liesen et al. ..... 508/469
6,271,184 B1 * 8/2001 Seebauer et al. ..... 508/469
6,300,288 B1 10/2001 Scharf et al. ..... 508/221
6,458,749 B2 * 10/2002 Kinker et al. ..... 508/469
6,712,991 B2 * 3/2004 Gore et al. ..... 252/79

FOREIGN PATENT DOCUMENTS

JP 2986850 B2 12/1999

OTHER PUBLICATIONS

Abstract of Chinese Patent No. CN 1006231 B, Accession No. 1989:176506, Caplus, Dec. 27, 1989.

* cited by examiner

*Primary Examiner*—Ellen M. McAvoy
(74) *Attorney, Agent, or Firm*—Teresan W. Gilbert; David M. Shold

(57) ABSTRACT

A grease composition containing a polymer with (a) monomers (i) at least one unsaturated α,β-carboxylic acid ester containing an alkyl group with about 10 to about 20 carbon atoms; and (ii) at least one unsaturated α,β-carboxylic acid ester containing an alkyl group with about 4 to about 11 carbon atoms different from monomer (i); and (iii) at least one unsaturated dicarboxylic acid anhydride or derivatives thereof; and (iv) optionally at least one unsaturated α,β-carboxylic acid ester containing an alkyl group with about 1 to about 3 carbon atoms; and optionally (b) at least one non-monomeric amine with primary functionality, secondary functionality or mixtures thereof; and optionally (c) other performance additives; and (d) at least one thickening agent, and (e) an oil of lubricating viscosity. The invention further relates to the process to make the composition and its use in greases.

15 Claims, No Drawings

FUNCTIONALIZED POLYMER COMPOSITION FOR GREASE

FIELD OF THE INVENTION

The present invention relates to a grease in particular a lubricating grease comprising: (a) a polymer comprising: (i) at least one unsaturated α,β-carboxylic acid ester containing an alkyl group with about 10 to about 20 carbon atoms; (ii) at least one unsaturated α,β-carboxylic acid ester containing an alkyl group with about 4 to about 11 carbon atoms different from monomer (i); (iii) at least one unsaturated dicarboxylic acid anhydride or derivatives thereof; (iv) optionally at least one unsaturated α,β-carboxylic acid ester containing an alkyl group with about 1 to about 3 carbon atoms; and (v) optionally at least one non-monomeric amine with primary functionality, secondary functionality or mixtures thereof; optionally (b) other performance additives; (c) at least one thickening agent, and (d) an oil of lubricating viscosity. The invention further relates to the process to make the novel additive compositions and its use in greases.

BACKGROUND OF THE INVENTION

It is known to prepare greases from base oil, a thickener and optionally other performance additives for example antioxidants or antiwear agents. Polymers have also been added to greases in an attempt to improve the performance characteristics of the grease, for example, polymers have been employed to decrease water wash-off, to increase water repellency, to decrease oil separation, to increase dropping points or cone penetration and as thickeners. Often the polymers of polymethacrylates or polyolefins are added to grease. Typically these polymers are incorporated in the base oil and act as a viscosity modifier. However, the polymers have limited interaction with the thickener. This results in the grease being more susceptible to the effects of water, for example, water wash-off or decreased water repellency. Producing greases with poor water wash-off or water repellency decreases the longevity of grease and increases wear on the surface being lubricated.

U.S. Pat. No. 5,000,862 discloses a process for lubricating and protecting bearings in a steel process mill. The process caster rollers have improved longevity, rust and corrosion by using grease containing a polymethacrylate additive. The polymethacrylate additive, imparts improved water resistance and reduced water wash-off. The polymethacrylate is not functionalised and does not interact with the base oil and thickener used to form the greases.

U.S. Pat. No. 4,929,371 discloses the use of polymers additives in greases selected from polyurethanes, polyoxides, polyamines, polyacrylamides, polyvinyl alcohols, ethylene vinyl acetates, polyvinyl acetates, polyvinyl pyrrolidones, polyolefins, polyolefin arylenes, polyarylenes and polymethacrylates. The polymers are thermally stable and minimise high temperature oxidation, corrosion, thermal breakdown, detrimental polymerisation of the grease and lacquering. The polymers are hydrophobic and extend the useful life of the greases. The polymers are unfunctionalised except when the polymers can be reacted with boric acid or boron containing compounds resulting in a borated polymer.

Chinese Patent Application 87105053A discloses lithium greases prepared by saponification of $C_{12}$-$C_{24}$ fatty acid and lithium hydroxide, a synthetic or mineral oil and an additive package containing polymethacrylate at 1 wt % of the grease composition. The polymethacrylate is not functionalised and does not interact with the base oil and thickener used to form greases.

U.S. Pat. No. 4,668,412 discloses polymers which have been functionalised and are capable of use in lubricating oils containing at least one (meth) acrylate monomer, a dicarboxylic acid anhydride, an amine and a functionalising Mannich base. The first and second (meth) acrylate esters are derived from alcohols with 10 to 16 carbon atoms, and 12 to 18 carbon atoms respectively. The dicarboxylic acid anhydride is maleic anhydride or derivatives thereof. The amine can be primary or secondary functionalised. The Mannich base is formed from the reaction of phenols, aldehydes and polyamines through the nitrogen of the polymer amine group.

It would be desirable to have an oil of lubricating viscosity containing polymers suitable for greases that are capable of imparting improved thickening, decreased water wash-off, increased water repellence, prolonged longevity and decreased wear.

The present invention provides a grease composition containing polymers capable of improving greases by imparting improved water wash-off and water repellence. The invention further provides a grease composition containing polymers capable of improving thickening. The invention further provides a grease composition containing polymers capable of decreasing wear and increasing longevity.

SUMMARY OF THE INVENTION

The present invention provides a grease in particular a lubricating grease composition comprising:

(a) A polymer comprising:
  - (i) at least one unsaturated α,β-carboxylic acid ester containing an alkyl group having about 10 to about 20 carbon atoms;
  - (ii) at least one unsaturated α,β-carboxylic acid ester containing an alkyl group having about 4 to about 11 carbon atoms different from monomer (i);
  - (iii) at least one unsaturated dicarboxylic acid anhydride or derivatives thereof; and
  - (iv) at least one unsaturated α,β-carboxylic acid ester containing an alkyl group having about 1 to about 3 carbon atoms present in the range from about 0 to about 9.9 wt % of the polymer composition;
  - (v) at least one non-monomeric amine with primary functionality, secondary functionality or mixtures thereof present in the range from about 0 to about 1 equivalents of the unsaturated dicarboxylic acid anhydride or derivatives thereof;

(b) other performance additives present in the range from about 0 to about 20 wt % of the composition;

(c) at least one thickening agent; and (d) an oil of lubricating viscosity resulting in a grease composition.

The invention further provides a process to prepare a grease in particular a lubricating grease comprising the steps of:

(1) mixing (a) monomers comprising (i) at least one unsaturated α,β-carboxylic acid ester containing an alkyl group having about 10 to about 20 carbon atoms; (ii) at least one unsaturated α,β-carboxylic acid ester containing an alkyl group having about 4 to about 11 carbon atoms different from monomer; (iii) optionally at least one unsaturated α,β-carboxylic acid ester containing an alkyl group having about 1 to about 3 carbon atoms, with (b) at least one initiator; with (c) at least one chain transfer agent;

(2) mixing a portion of product of step (1) with at least one unsaturated dicarboxylic acid anhydride or derivatives thereof;

(3) heating the mixture in step (2) to a temperature in the range of about 70° C. to about 200° C. from about 3 minutes to about 12 hours, cooling to a temperature in the range from about 80° C. to about 130° C.;

(4) adding the remaining portion of step (1) to the product of step (3) and polymerising the unreacted monomers resulting in a polymer;

(5) optionally adding to the polymer at least one non-monomeric amine with primary functionality, secondary functionality or mixtures thereof resulting in an amidated polymer;

(6) adding at least one thickening agent to the polymer of step (4) or the amidated polymer of step (5); or during or subsequent to the amidated polymer; and an oil of lubricating viscosity; and (7) optionally adding to the product of step (6) other performance additives selected from the group consisting of antioxidants, rust inhibitors, metal deactivators, antiwear agents, antiscuffing agents, extreme pressure agents, foam inhibitors, demulsifiers, friction modifiers, viscosity modifiers, pour point depressants and mixtures thereof; resulting in a grease composition.

The present invention further provides a grease composition containing polymers capable of improving greases by imparting improved water wash-off and water repellence. The invention further provides a grease composition containing polymers capable of improving thickening. The invention further provides a grease composition containing polymers capable of decreasing wear and increasing longevity.

DETAILED DESCRIPTION OF THE INVENTION

The present invention provides a grease composition comprising:

(a) A polymer comprising:

(i) at least one unsaturated α,β-carboxylic acid ester containing an alkyl group having about 10 to about 20 carbon atoms;

(ii) at least one unsaturated α,β-carboxylic acid ester containing an alkyl group having about 4 to about 11 carbon atoms different from monomer (i);

(iii) at least one unsaturated dicarboxylic acid anhydride or derivatives thereof; and (iv) at least one unsaturated α,β-carboxylic acid ester containing an alkyl group having about 1 to about 3 carbon atoms present in the range from about 0 to about 9.9 wt % of the polymer composition;

(v) at least one non-monomeric amine with primary functionality, secondary functionality or mixtures thereof present in the range from about 0 to about 1 equivalents of the unsaturated dicarboxylic acid anhydride or derivatives thereof;

(b) other performance additives present in the range from about 0 to about 20 wt % of the composition;

(c) at least one thickening agent; and (d) an oil of lubricating viscosity resulting in a grease composition.

The molecular weight of the polymer derived from component (a) monomers (i)-(iv), can be controlled using a variety of known techniques such as reaction temperature, initiators, monomer concentration and chain transfer agents. The molecular weight ($M_w$) of the polymer is in the range from about 1000 to about 1,000,000, preferably about 5000 to about 750,000, more preferably about 10,000 to about 600,000, even more preferably about 100,000 to about 650,000 and most preferably about 200,000 to about 500,000.

The polymer is present in a grease composition in the range from about 0.01 to about 30, preferably about 0.04 to about 20, even more preferably about 0.07 to about 10 and most preferably about 0.1 to about 5 weight percent of the lubricating oil composition.

Unsaturated α,β-Carboxylic Acid Esters Containing 10 to 20 Carbon Atoms

The esters derived from at least one unsaturated α,β-carboxylic acid ester containing an alkyl group with about 10 to about 20 carbon atoms suitable for the compositions of the invention can be represented by the formula:

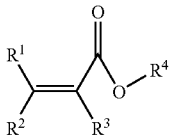

(I)

wherein, $R^1$ and $R^2$ are independently hydrogen, hydrocarbyl groups, or mixtures thereof. The hydrocarbyl groups can contain about 1 to about 20, more preferably from about 1 to about 10, most preferably from about 1 to about 4 carbon atoms; and linear or branched and selected from the group consisting of alkyl, cycloalkyl, aryl, arylalkyl and mixtures thereof. The hydrocarbyl groups can be also be substituted, unsubstituted or mixtures thereof. In one embodiment, the hydrocarbyl groups can be a branched alkyl group or mixtures thereof. In one embodiment the hydrocarbyl groups can be a linear alkyl group or mixtures thereof. $R^3$ is hydrogen, methyl or mixtures thereof.

$R^4$ can be derived from alkyl groups with about 10 to about 20, preferably about 10 to about 18, more preferably about 11 to about 16 and most preferably about 12 to about 15 carbon atoms. The alkyl can be linear or branched and selected from the group consisting of alkyl, cycloalkyl, arylalkyl and mixtures thereof. In one embodiment, the alkyl group can be branched or mixtures thereof. In another embodiment the alkyl group can be linear or mixtures thereof. The alkyl group can be also be substituted, unsubstituted or mixtures thereof. Although the alkyl group can be substituted, unsubstituted is preferred.

Suitable unsaturated α,β-carboxylic acid esters containing an alkyl group with about 10 to about 20 carbon atoms include but are not limited to capryl (meth) acrylate, decyl (meth) acrylate, isodecyl (meth) acrylate, undecyl (meth) acrylate, dodecyl (meth) acrylate, tridecyl (meth) acrylate, lauryl (meth) acrylate, tridecyl (meth) acrylate, myristyl (meth) acrylate, pentadecyl (meth) acrylate, palmityl (meth) acrylate, heptadecyl (meth) acrylate, stearyl (meth) acrylate, octadecyl (meth) acrylate, nonadecyl (meth) acrylate, icosyl (meth) acrylate and mixtures thereof. Preferably the unsaturated α,β-carboxylic acid esters include but are not limited to dodecyl (meth) acrylate, tridecyl (meth) acrylate, lauryl (meth) acrylate, tridecyl (meth) acrylate, myristyl (meth) acrylate, pentadecyl (meth) acrylate and mixtures thereof. Typically these unsaturated α,β-carboxylic acid esters are commercially available as mixtures.

The monomer derived from at least one unsaturated α,β-carboxylic acid ester containing an alkyl group with about 10 to about 20 carbon atoms is present in the polymer with a weight percent based on the total weight of the polymer in the range from about 9.9 wt % to about 99 wt %, preferably about 25 wt % to about 90 wt %, more preferably about 48 wt % to about 85 wt % and most preferably about 60 wt % to about 72 wt %.

Unsaturated α,β-Carboxylic Acid Esters Containing 4 to 11 Carbon Atoms

The esters derived from at least one unsaturated α,β-carboxylic acid ester containing an alkyl group with about 4 to about 11 carbon atoms suitable for the compositions of the invention can be represented by the formula:

(II)

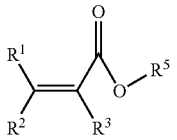

wherein $R^1$, $R^2$ and $R^3$ are as described above. $R^5$ can be derived from alkyl groups with about 4 to about 11, preferably about 5 to about 11, more preferably about 5 to about 10 and most preferably about 6 to about 10 carbon atoms provided that $R^5$ is different from $R^4$. The alkyl can be linear or branched and selected from the group consisting of alkyl, cycloalkyl, arylalkyl and mixtures thereof. In one embodiment, the alkyl group can be branched or mixtures thereof. In another embodiment the alkyl group can be linear or mixtures thereof. The alkyl group can be substituted, unsubstituted or mixtures thereof. Although the alkyl group can be substituted, unsubstituted is preferred.

Examples of suitable unsaturated α,β-carboxylic acid esters containing an alkyl group with about 4 to about 11 carbon atoms include but are not limited to butyl (meth) acrylate, pentyl (meth) acrylate, hexyl (meth) acrylate, heptyl (meth) acrylate, octyl (meth) acrylate, nonyl (meth) acrylate, decyl (meth) acrylate, undecyl (meth) acrylate, 2-ethylhexyl (meth) acrylate, 2-ethyl-1-pentyl (meth) acrylate, 3-ethyl-1-pentyl (meth) acrylate, 4-ethyl-1-pentyl (meth) acrylate, 2,4,4-trimethyl-1-hexyl (meth) acrylate, 3,5,5-trimethyl-1-hexyl (meth) acrylate, 3,7-dimethyl-1-octyl (meth) acrylate, 3,7-dimethyl-2-octyl (meth) acrylate, 3,7-dimethyl-3-octyl (meth) acrylate and mixtures thereof. Preferably unsaturated α,β-carboxylic acid esters containing an alkyl group with about 4 to about 11 carbon atoms include but are not limited to 2-ethylhexyl (meth) acrylate and may be used alone or in combination.

The monomer derived from at least one unsaturated α,β-carboxylic acid ester containing an alkyl group with about 4 to about 11 carbon atoms is present in the polymer with a weight percent based on the total weight of the polymer in the range from about 0.1 wt % to about 80 wt %, preferably about 5 wt % to about 65 wt %, more preferably about 10 wt % to about 50 wt % and most preferably about 25 wt % to about 35 wt %.

Unsaturated α,β-Carboxylic Acid Esters Containing 1 to 3 Carbon Atoms

The esters derived from at least one unsaturated α,β-carboxylic acid ester containing an alkyl group with about 1 to about 3 carbon atoms suitable for the compositions of the invention can be represented by the formula:

(III)

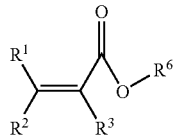

wherein $R^1$, $R^2$ and $R^3$ are as described above. $R^6$ can be derived from alkyl groups with about 1 to about 3, preferably about 1 to about 2 carbon atoms, and most preferably 1 carbon atom. The alkyl can be linear or branched or mixtures thereof. Although the alkyl group can be branched linear is preferred. The alkyl group can be substituted, unsubstituted or mixtures thereof. Although the alkyl group can be substituted, unsubstituted is preferred.

Examples of suitable unsaturated α,β-carboxylic acid esters containing an alkyl group with about 1 to about 3 carbon atoms include but are not limited to methyl (meth) acrylate, ethyl (meth) acrylate, propyl (meth) acrylate and mixtures thereof. Preferably the unsaturated α,β-carboxylic acid esters containing an alkyl group with about 1 to about 3 carbon atoms is methyl (meth) acrylate and may be used alone or in combination.

The monomer derived from at least one unsaturated α,β-carboxylic acid ester containing an alkyl group with about 1 to about 3 carbon atoms is present in the polymer with a weight percent based on the total weight of the polymer in the range from about 0 wt % to about 9.9 wt %, preferably about 0.25 wt % to about 5 wt %, more preferably about 1 wt % to about 3.5 wt % and most preferably about 1.5 wt % to about 2.5 wt % of the polymer composition.

Unsaturated Dicarboxylic Acid Anhydride or Derivatives Thereof Functionality

The copolymer further contains at least one unsaturated dicarboxylic acid anhydride or derivatives thereof functionality suitable for the compositions of the invention can be derived from maleic anhydride represented by the formula:

(IV)

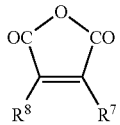

wherein $R^7$ and $R^8$ can be independently hydrogen or hydrocarbyl groups containing about 1 to about 40, preferably about 1 to about 30, more preferably about 1 to about 20 and most preferably about 1 to about 10 carbon atoms. The carbon atoms of the hydrocarbyl group can be alkyl, alkylaryl, cycloalkyl, aryl or mixtures thereof. The hydrocarbyl groups can be substituted, unsubstituted, branched, unbranched or mixtures thereof, although, unsubstituted is preferred. Derivatives of the maleic structure shown in formula (IV) are selected from the group consisting of anhydrides, esters, acids, salts and mixtures thereof.

Suitable salts include but are not limited to alkali metals, alkaline metal and mixtures thereof. Preferably the salts can contain lithium, sodium, potassium, magnesium, calcium and mixtures thereof.

Suitable examples of the unsaturated dicarboxylic acid anhydride or derivatives thereof functionality suitable for the compositions of the invention include but are not limited to maleic anhydride, methyl maleic anhydride, ethyl maleic anhydride, dimethyl maleic anhydride or mixtures thereof. A preferred unsaturated dicarboxylic acid anhydride or derivatives thereof functionality is maleic anhydride and can be used alone or in combination.

An unsaturated dicarboxylic acid anhydride or derivatives thereof functionality is present in the polymer with a weight percent based on the total weight of the polymer in the range from about 0.1 wt % to about 10 wt %, preferably about 0.25 wt % to about 5 wt %, more preferably about 1 wt % to about 3.5 wt % and most preferably about 1.5 wt % to about 2.5 wt %.

Non-Monomeric Amine

As used herein, the term "non-monomeric amine" is used to describe an amine that is not capable of polymerising with monomers (i), (ii), (iii) and (iv), as described above.

The lubricating oil composition can optionally contain at least one non-monomeric amine that can be selected from monoamines, polyamines and mixtures thereof. The amines can be cyclic, linear or branched and are selected from the group consisting of alkylenemonoamines, heterocyclic monoamines, alkylenepolyamines, heterocyclic polyamines and mixtures thereof, preferably the amines contain not more than one primary or secondary amino group.

In one embodiment the alkylenepolyamines can be selected from the group consisting of ethylenepolyamines, propylenepolyamines, butylenepolyamines and mixtures thereof. Examples of propylenepolyamines include but are not limited to propylenediamine, dipropylenetriamine and mixtures thereof. Ethylenepolyamines are preferred and include but are not limited to ethylenediamine, diethylenetriamine, triethylenetetramine, tetraethylenepentamine, pentaethylenehexamine, polyamine still bottoms and mixtures thereof.

In one embodiment the polyamines can be α,β-diaminoalkanes. Suitable α,β-diaminoalkanes include but are not limited to diaminopropanes, diaminobutanes or mixtures thereof. Specific diaminoalkanes are selected from the group consisting of N-(2-aminoethyl)-1,3-propane diamine, 3,3'-diamine-N-methyldipropylamine, tris(2-aminoethyl)amine, N,N-bis(3-aminopropyl)-1,3-propane diamine, N,N'-1,2-ethanediylbis-(1,3-propane diamine) and mixtures thereof.

In one embodiment other polyamines include but not limited to di-(trimethylene)triamine, piperazine, diaminocyclohexanes and mixtures thereof.

In one embodiment the amine can be cyclic and can include but not limited to compounds that are represented by the formula:

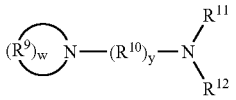

(V)

wherein $R^9$ can be atoms bonded to form mono- or polynuclear rings; and the atoms are selected from the group consisting of carbon, oxygen, nitrogen, phosphorus and mixtures thereof. Preferably $R^9$ can be atoms selected from the group consisting of carbon, oxygen, nitrogen and mixtures thereof.

The mononuclear cyclic structure contains about 5 to about 8 atoms and preferably about 6 to about 7 atoms. The polynuclear cyclic structure contains about 8 to about 16 and preferably about 10 to about 12 atoms. w can be in the range from about 4 to about 15, preferably about 5 to about 11, more preferably about 5 to about 8 atoms. The cyclic ring can be aromatic, non-aromatic or mixtures thereof, although non-aromatic is preferred.

$R^{10}$ can be alkyl or alkenyl group with y containing about 1 to about 8, preferably about 1 to about 6, and most preferably about 2 to about 5 carbon atoms. The alkyl or alkenyl group can be substituted, unsubstituted, branched, unbranched alkylaryl, cycloalkyl or mixtures thereof. Suitable examples of $R^{10}$ include but are not limited to ethyl, propyl, butyl, pentyl and mixtures thereof. Preferably $R^{10}$ is ethyl, propyl or mixtures thereof.

$R^{11}$ and $R^{12}$ can be hydrogen or hydrocarbyl, preferably at least one, and most preferably both of $R^{11}$ and $R^{12}$ are hydrogen. When $R^{11}$ or $R^{12}$ is hydrocarbyl, the number of carbon atoms present is in the range from about 1 to about 8, preferably about 1 to about 5 and most preferably about 1 to about 3 or mixtures thereof. Suitable examples of hydrocarbyl groups include but are not limited to methyl, ethyl, propyl, butyl, pentyl and mixtures thereof.

Examples of suitable cyclic amines include but are not limited to 4-(3-aminopropyl) morpholine, 4-(3-aminoethyl) morpholine or mixtures thereof. Preferably the cyclic amine is 4-(3-aminopropyl) morpholine and may be used alone or in combination.

The amines when present are in an effective amount to substantially react with the monomer (iii) and leaving no residual amine present in the polymers. Preferably the amine is present in a sufficient amount to ensure it reacts with all of monomer (iii) and leaving no residual present in the polymers. Typically the amine is present weight percent based on the total weight of the polymer in the range from about 0 to about 1, preferably about 0.1 to about 1, more preferably about 0.2 to about 1 and most preferably about 0.4 to about 1 equivalents of the unsaturated dicarboxylic acid anhydride or derivatives thereof.

The polymer described above preferably does not contain Mannich base functionality. The Mannich base can be formed by the reaction of (a) an aldehyde, with (b) a phenols and (c) at least one non-monomeric amine with primary functionality, secondary functionality or mixtures thereof.

The Thickening Agent

Thickening agents such as metal salts of carboxylic acids are known in the art of grease formulation. Often the metal is an alkali metal, alkaline metal, aluminium or mixtures thereof. Examples of suitable metals include but are not limited to lithium, potassium, sodium, calcium, magnesium, barium, aluminium and mixtures thereof. Preferably the metal is lithium, calcium, aluminium or mixtures thereof.

The carboxylic acid used in the thickener is often a fatty acid and can be a mono- or poly-hydroxycarboxylic acid. The carboxylic acid has about 4 to about 30, preferably about 8 to about 27, more preferably about 19 to about 24 and most preferably about 10 to about 20 carbon atoms. Examples of suitable fatty acids include but are not limited to capric acid, palmitic acid, stearic acid, oleic acid and mixtures thereof. Preferably the fatty acid is a stearic acid and can be used alone or in combination.

In one embodiment the carboxylic acid thickener can be a hydroxy-substituted fatty acid or mixtures thereof. A particularly preferred hydroxy-substituted fatty acid is hydroxy stearic acid, wherein one or more hydroxy groups can be located at positions 10-, 11-, 12-, 13- or 14- on the alkyl group. Suitable examples can include but are not limited to 10-hydroxystearic acid, 11-hydroxystearic acid, 12-hydroxystearic acid, 13-hydroxystearic acid, 14-hydroxystearic acid and mixtures thereof. In one embodiment the hydroxy-substituted fatty acid is 12-hydroxystearic acid.

The thickener can also be prepared directly from at least one fatty acid source, such as vegetable oil or animal fats, by saponification. The thickener can be prepared directly from a fatty acid and can be hydrogenated castor oil, glyceride or other esters containing alkyl groups. The alkyl groups can contain about 1 to about 10, preferably about 1 to about 5 and most preferably about 1 to about 3 carbon atoms. Suitable examples of alkyl groups for the fatty acid esters include but are not limited to methyl, ethyl, propyl, butyl, pentyl, glycerol and mixtures thereof.

In one aspect of the invention thickening agents can be inorganic powders selected from the group consisting of clay, organo-clays, bentonite, fumed silica, calcite, carbon black, pigments, copper phthalocyanine and mixtures thereof. In one embodiment the calcite containing thickeners made from overbased calcium sulphonate or carboxylates can be used The thickener is present in the range from about 3 to about 30, preferably from about 4 to about 25, even more preferably about 4 to about 18 and most preferably from about 5 to about 18 weight percent of the lubricating oil composition. The thickener may be used alone or mixtures thereof.

Oil of Lubricating Viscosity

The lubricating oil compositions of the present invention include but are not limited to natural or synthetic oils of lubricating viscosity, oil derived from hydrocracking, hydrogenation, hydrofinishing, unrefined, refined and re-refined oils, and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils include but are not limited to animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale and mixtures thereof.

Synthetic lubricating oils include but are not limited to hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls,); alkylated diphenyl ethers and alkylated diphenyl sulphides and the derivatives, analogs and homologs thereof and mixtures thereof.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methylhexyl)silicate, tetra-(p-tert-butylphenyl) silicate, hexyl-(4-methyl-2-pentoxy) disiloxane, poly(methyl) siloxanes, and poly-(methylphenyl)siloxanes).

Other synthetic lubricating oils include but are not limited to liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes.

Oils of lubricating viscosity can also be defined as specified in the American Petroleum Institute (API) Base Oil Interchangeability Guidelines. The five base oil groups are as follows: Group I sulphur content >0.03 wt %, and/or <90 wt % saturates, viscosity index 80-120; Group II sulphur content ≦0.03 wt %, and ≧90 wt % saturates, viscosity index 80-120; Group III sulphur content ≦0.03 wt %, and ≧90 wt % saturates, viscosity index ≧120; Group IV all polyalphaolefins (PAO's); and Group V all others not included in Groups I, II, III, or IV. In one embodiment the oil of lubricating viscosity comprises an API Group I, II, III, IV, V or mixtures thereof, and preferably API Group I, II, III or mixtures thereof.

The oil of lubricating viscosity is present in the range from about 20 to about 97, preferably from about 40 to about 96, even more preferably about 60 to about 96 and most preferably from about 67 to about 95 weight percent of the lubricating oil composition. The oil of lubricating viscosity may be used alone or mixtures thereof.

Other Performance Additives

Optionally, the composition can include other performance additives selected from the group consisting of antioxidants, rust inhibitors, metal deactivators, antiwear agents, antiscuffing agents, extreme pressure agents, foam inhibitors, demulsifiers, friction modifiers, viscosity modifiers, pour point depressants and mixtures thereof.

The total combined amount of the other performance additives present can be in the range from about 0 to about 20, preferably about 0.1 to about 15, even more preferably about 0.2 to about 10 and most preferably about 0.4 to about 10 weight percent of the lubricating oil composition.

Antioxidants

Antioxidants include but are not limited to hindered phenols represented by the formula:

(VI)

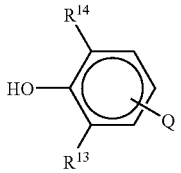

wherein $R^{13}$ and $R^{14}$ are independently branched or linear alkyl groups containing about 1 to about 24, preferably about 4 to about 18, and most preferably about 4 to about 12 carbon atoms.

$R^{13}$ and $R^{14}$ can be either straight or branched chain; branched is preferred. Preferably the phenol is butyl substituted containing two t-butyl groups. When the t-butyl groups occupy the 2,6-positions, the phenol is sterically hindered. Q is hydrogen or hydrocarbyl. Examples of suitable hydrocarbyl groups include but are not limited to 2-ethylhexyl, n-butyl, dodecyl and mixtures thereof.

Other optional sterically hindered phenols suitable for the invention include but are not limited to those represented by the formulae:

(VII)

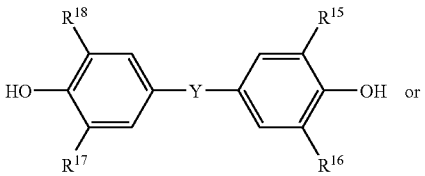

(VIII)

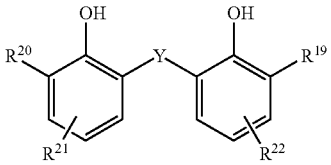

wherein $R^{15}$, $R^{16}$, $R^{17}$, $R^{18}$, $R^{19}$, $R^{20}$ are either straight or branched chain and contain about 4 to about 18, preferably about 4 to about 12 carbon atoms. Preferably the phenol is butyl substituted. $R^{21}$ and $R^{22}$ are independently hydrogen or hydrocarbyl; preferably $R^{21}$ and $R^{22}$ are arylalkyl, alkyl or mixtures thereof. The alkyl groups can be linear or branched, linear being preferred. $R^{21}$ and $R^{22}$ are preferably in the para position to the —OH group. The arylalkyl or alkyl groups typically contain 1 to 15, preferably 1 to 10, and more preferably 1 to 5 carbon atoms. The bridging group Y include but are not limited to —$CH_2$— (methylene bridge) or —$CH_2OCH_2$— (ether bridge) and mixtures thereof.

Examples of methylene-bridged sterically hindered phenols include but are not limited to 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylene-bis(2,6-di-tertbutylphenol) and mixtures thereof.

In one embodiment the antioxidant is a hindered ester-substituted phenol represented by the formula:

(IX)

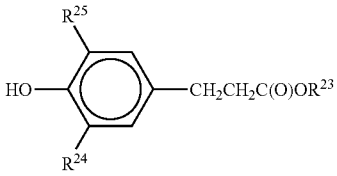

wherein $R^{23}$, $R^{24}$ and $R^{25}$ are straight or branched alkyl group containing about 2 to about 22, preferably about 2 to about 18, more preferably about 4 to about 8 carbon atoms. Specific examples of alkyl groups include but are not limited to 2-ethylhexyl, n-butyl ester, dodecyl and mixtures thereof.

Another class of antioxidant is alkylated diphenylamines that can be represented by the following formula:

(X)

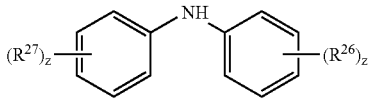

wherein $R^{26}$ and $R^{27}$ are independently hydrogen or hydrocarbyl, preferably arylalkyl or alkyl groups. The arylalkyl groups contain about 5 to about 20, preferably about 6 to about 10 carbons atoms. The alkyl groups can be linear or branched, preferably linear; the alkyl group contains about 1 to about 24, preferably about 2 to about 18 and most preferably about 4 to about 12 carbon atoms; and z is independently 0, 1, 2, or 3, provided that at least one aromatic ring contains a hydrocarbyl group. Preferred alkylated diphenylamines can include but are not limited to bis-nonylated diphenylamine and bis-octylated diphenylamine and mixtures thereof. The antioxidants can be used alone or in combination.

Rust Inhibitors

Rust inhibitors are known and include but are not limited to amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, and half esters of alkenyl succinic acids in which the alkenyl radical contains about 8 to about 24 carbon atoms with alcohols such as polyglycols. The rust inhibitors can be used alone or in combination.

Metal Deactivators

Metal deactivators can be used to neutralise the catalytic effect of metal for promoting oxidation in lubricating oil. Examples of metal deactivators include but are not limited to derivatives of benzotriazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercapto thiadiazoles and mixtures thereof.

Preferably the metal deactivator is a hydrocarbyl substituted benzotriazole compound. The benzotriazole compounds with hydrocarbyl substitutions include at least one of the following ring positions 1- or 2- or 4- or 5- or 6- or 7-benzotriazoles. The hydrocarbyl groups contain about 1 to about 30, preferably about 1 to about 15, more preferably about 1 to about 7 carbon atoms, and most preferably the metal deactivator is 5-methylbenzotriazole and may be used alone or in combination.

Antiwear Agents

The lubricant may additionally contain an antiwear agent. Useful antiwear agents include but are not limited to metal thiophosphates, especially zinc dialkyldithiophosphates; phosphoric acid esters or salt thereof; phosphites; and phosphorus-containing carboxylic esters, ethers, and amides. The antiwear agent can be used alone or in combination.

Antiscuffing Agents

The lubricant may also contain an antiscuffing agent. Antiscuffing agents that decrease adhesive wear are often sulphur containing compounds. Typically the sulphur containing compounds include but are not limited to organic sulphides and polysulphides, such as benzyldisulphide, bis- (chlorobenzyl) disulphide, dibutyl tetrasulphide, di-tertiary butyl polysulphide, sulphurised sperm oil, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof. The antiscuffing agents can be used alone or in combination.

Extreme Pressure Agents

Extreme Pressure (EP) agents that are soluble in the oil include sulphur and chlorosulphur-containing EP agents, chlorinated hydrocarbon EP agents, phosphorus EP agents, and mixtures thereof. Examples of such EP agents include but are not limited to compounds selected from the group consisting of chlorinated wax, organic sulphides and polysulphides, such as benzyldisulphide, bis-(chlorobenzyl) disulphide, dibutyl tetrasulphide, sulphurised sperm oil, sulphurised methyl ester of oleic acid, sulphurised alkylphenol, sulphurised dipentene, sulphurised terpene, and sulphurised Diels-Alder adducts; phosphosulphurised hydrocarbons, such as the reaction product of phosphorus sulphide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite, metal thiocarbamates, such as zinc dioctyldithiocarbamate and barium heptylphenol diacid, such as zinc dicyclohexyl phosphorodithioate and the zinc salts of a phosphorodithioic acid; and mixtures thereof. The extreme pressure agents can be used alone or in combination.

Foam Inhibitors

Foam inhibitors are known and include but are not limited to organic silicones such as polyacetates, dimethyl silicone, polysiloxanes, polyacrylates or mixtures thereof.

Examples of foam inhibitors include but are not limited to poly ethyl acrylate, poly 2-ethylhexylacrylate, poly vinyl acetate and mixtures thereof. Foam inhibitors can be used alone or in combination.

Demulsifiers

Demulsifiers are known and include but are not limited to derivatives of propylene oxide, ethylene oxide, polyoxyalkylene alcohols, alkyl amines, amino alcohols, diamines or polyamines reacted sequentially with ethylene oxide or substituted ethylene oxides and mixtures thereof.

Examples of demulsifiers include but are not limited to trialkyl phosphates, polyethylene glycols, polyethylene oxides, polypropylene oxides, (ethylene oxide-propylene oxide) polymers and mixtures thereof. Demulsifiers can be used alone or in combination.

Pour Point Depressants

Pour point depressants are known and include but are not limited to esters of maleic anhydride-styrene copolymers, polymethacrylates; polyacrylates; polyacrylamides; condensation products of haloparaffin waxes and aromatic compounds; vinyl carboxylate polymers; and terpolymers of dialkylfumarates, vinyl esters of fatty acids, ethylene-vinyl acetate copolymers, alkyl phenol formaldehyde condensation resins, alkyl vinyl ethers and mixtures thereof. Pour point depressants can be used alone or in combination.

Friction Modifiers

The lubricant may additionally contain a friction modifier. Useful friction modifiers include but are not limited to fatty amines, esters, especially glycerol esters such as glycerol monooleate, borated glycerol esters, fatty phosphites, fatty acid amides, fatty epoxides, borated fatty epoxides, alkoxylated fatty amines, borated alkoxylated fatty amines, metal salts of fatty acids, sulfurized olefins, fatty imidazolines, condensation products of carboxylic acids and polyalkylenepolyamines, amine salts of alkylphosphoric acids, and molybdenum-containing friction modifiers such as molybdenum dithiocarbamates and mixtures thereof. Friction modifiers can be used alone or in combination.

Viscosity Modifiers

Viscosity modifiers are known and include but are not limited to copolymers of styrene-butadiene rubbers, ethylene-propylene, polyisobutenes, hydrogenated styrene-isoprene polymers, hydrogenated radical isoprene polymers, polymethacrylate acid esters, polyacrylate acid esters, polyalkyl styrenes, alkenyl aryl conjugated diene copolymers, polyolefins, polyalkylmethacrylates, esters of maleic anhydride-styrene copolymers and mixtures thereof. Viscosity modifiers can be used alone or in combination.

Process

The invention is further a process to prepare a grease composition comprising the steps of:

(1) mixing (a) monomers comprising (i) at least one unsaturated α,β-carboxylic acid ester containing an alkyl group with about 10 to about 20 carbon atoms; (ii) at least one unsaturated α,β-carboxylic acid ester containing an alkyl group with about 4 to about 11 carbon atoms different from monomer; (iii) optionally at least one unsaturated α,β-carboxylic acid ester containing an alkyl group with about 1 to about 3 carbon atoms, with (b) at least one initiator; with (c) at least one chain transfer agent; and (d); and optionally solvents;

(2) mixing a portion of product of step (1) with at least one unsaturated dicarboxylic acid anhydride or derivatives thereof at a temperature in the range of about 25° C. to about 100° C.; preferably about 30° C. to about 80° C. and most preferably about 35° C. to about 60° C.; at pressures in the range about 650 mm of Hg (about 86.7 kPa) to about 2000 mm of Hg (about 266.6 kPa), preferably about 690 mm of Hg (about 92 kPa) to about 1500 mm of Hg (about 200 kPa), and most preferably about 715 mm of Hg (about 95 kPa) to about 1000 mm of Hg (about 133 kPa);

(3) then heating the mixture in step (2) to a temperature in the range of about 70° C. to about 200° C. and holding for a period of time from about 3 minutes to about 12 hours, preferably about 4 minutes to about 8 hours and most preferably about 5 minutes to about 6 hours; at pressures in the range about 650 mm of Hg (about 86.7 kPa) to about 2000 mm of Hg (about 266.6 kPa), before cooling to a temperature in the range from about 80° C. to about 130° C. preferably about 90° C. to about 125° C. and most preferably about 99° C. to about 120° C.; at pressures in the range about 650 mm of Hg (about 86.7 kPa) to about 2000 mm of Hg (about 266.6 kPa), preferably about 690 mm of Hg (about 92 kPa) to about 1500 mm of Hg (about 200 kPa), and most preferably about 715 mm of Hg (about 95 kPa) to about 1000 mm of Hg (about 133 kPa);

(4) adding the remaining portion of step (1) to the product of step (3) and polymerising the unreacted monomers resulting in a polymer typically over a period of about 0.25 to about 12 hours and holding for a period of time from about 0.1 hours to about 24 hours, in the range from about 80° C. to about 130° C. to reduce the amount of unreacted monomer in the polymer;

(5) optionally, adding to the polymer at least one non-monomeric amine with primary functionality, secondary functionality or mixtures thereof resulting in an amidated polymer;

(6) adding at least one thickening agent to the polymer of step (4) or the amidated polymer of step (5); or during or subsequent to the amidated polymer; and an oil of lubricating viscosity; and (7) optionally adding to the product of step (6) adding other performance additives to form a grease composition.

Preferably the polymerisation reaction in step (5) is at least 50%, more preferably at least 70%, even more preferably at least 90% and most preferably at least 97% complete.

The polymers of the invention may be prepared using various batch, semi batch or continuous techniques known in the art including free radical, solution, anionic, bulk, emulsion or suspension polymerisation.

The optional solvents suitable for the polymerisation of the polymers of the invention can be aliphatic solvents, aromatic solvents, alcohols, ethers, esters, an oil of lubricating viscosity and mixtures thereof. Examples of suitable the optional solvents include but are not limited to hexane, cyclohexane, heptane, mineral spirits, petroleum ether, benzene, toluene; iso-propanol, iso-butanol, 2-ethylhexanol, diethyl ether, methyl tert-butyl ether, ethyl acetate, iso-amyl acetate or mixtures thereof.

When used as a solvent, the oil of lubricating viscosity can be the same or different to the oil of lubricating viscosity of the grease. Although the oil of lubricating viscosity can be different, preferably it is the same as the oil of lubricating viscosity of the grease. The solvents when present, can be used alone or in combination.

Chain transfer agents suitable for the preparation of said copolymers include but are not limited to compounds with labile sulphur compounds. The sulphur compounds can include but are not limited to benzoyl di-sulphide and mercaptans such as dodecyl mercaptans, ethyl mercaptans, preferably the chain transfer agent is n-dodecylmercaptan. The chain transfer agent may be used alone or in combination.

The amount of chain transfer agents added to the reaction mixture is in the range of about 0.0075 to about 4 weight percent of the monomers, more preferably about 0.01 to about 3.25 weight percent of the monomers, and most preferably about 0.02 to about 2.5 weight percent of the monomers.

Initiators suitable for the preparation of said polymers include, but are not limited to peroxides, azo compounds and mixtures thereof. Suitable peroxide compounds include but are not limited to tertiary butyl hydroperoxide, tertiary butyl peroxide, tertiary amyl peroxide, cumyl peroxide or dibenzoyl peroxide and mixtures thereof. Suitable azo compounds include but are not limited to 2,2'-azobis(isobutyronitrile), azobis(methylbutyronitrile) and mixtures thereof. Preferably the initiator is tertiary butyl peroxy-2-ethylhexanoate. The initiators may be used alone or in combination.

The amount of initiator added to the reaction mixture is in the range about 0.01 to about 10 weight percent of the monomers, preferably about 0.05 to about 3 weight percent, more preferably about 0.1 to about 2 weight percent, and most preferably about 0.5 to about 1.5 weight percent of the monomers.

When the copolymers of the invention are prepared in the presence of a solvent, the solvent can be an inert hydrocarbon lubricating oil. Preferably the solvent is identical or substantially similar to the oil in which the copolymer is to be used. The solvent may be used alone or in combination.

INDUSTRIAL APPLICATION

The grease composition of the present invention will typically exhibit at least one improved property selected from the group consisting of improved water repellence, improved water wash-off, improved thickening, increased longevity, decreased wear and mixtures thereof. In one embodiment the grease composition can be used in an emulsified grease.

The following examples provide an illustration of the invention. It should however be noted that these examples are non exhaustive and not intended to limit the scope of the invention.

Specific Embodiment

EXAMPLES

Examples 1 to 8 and Comparative Example C1

For all the examples, the grease formulations are prepared using an NLGI grade 2 grease containg lithium 12-hydroxy stearate. The grease formulation contains polymer compositions characterised in Table 1, as shown below. Monomers (i), (ii) and (iii) are $C_{12}$-$C_{15}$ methacrylate, 2-ethylhexyl methacrylate and maleic anhydride respectively. Examples 1 and 2 further contain aminopropylmorpholine, which is used to functionalise the maleic anhydride residue in the polymer. The molar ratio of maleic anhydride to aminopropylmorpholine is 1:1. Comparative example C1 is a typical grease formulation and does not contain polymer formed from monomers (i)-(iv) nor amidated polymer derivatives thereof.

TABLE 1

Copolymer Characterisation Data

| Example | wt % of Monomers (I) | (II) | (III) | Approximate Mw | Treat Rate (wt % of lubricating Composition) |
|---|---|---|---|---|---|
| C1 | N/A | N/A | N/A | N/A | N/A |
| 1 | 68 | 30 | 2 | 34,200 | 0.3 |
| 2 | 68 | 30 | 2 | 34,200 | 1.23 |
| 3 | 68 | 30 | 2 | 67,300 | 0.3 |
| 4 | 68 | 30 | 2 | 67,300 | 1.23 |
| 5 | 68.2 | 30 | 1.8 | 506,000 | 0.25 |
| 6 | 68.2 | 30 | 1.8 | 506,000 | 0.6 |
| 7 | 68.2 | 30 | 1.8 | 221,000 | 0.25 |
| 8 | 68.2 | 30 | 1.8 | 221,000 | 0.6 |

Test 1

The ASTM D4049 test measures the resistance of grease to water spray. A pre-weighed stainless steel panel is evenly coated with about 8 mm of grease. The panel is the reweighed. The coated stainless steel panel is then placed in a water spray for about 5 minutes. The water is preheated to about 38° C. and held at constant temperature. The water pressure pump is held at about 276 kPa (equivalent to about 40 psi). The panel is removed from the spray and heated in an oven for about 1 hour at about 66° C. The panel is then removed from the oven, allowed to cool and is reweighed. The results obtained for the grease compositions are shown in Table 2 below.

TABLE 2

| ASTM D4049 Results | |
|---|---|
| Example | % Grease Removed by Water Spray |
| C1 | 60 |
| 1 | 28.9 |
| 2 | 28.8 |
| 3 | 28.0 |
| 4 | 34.8 |
| 5 | 32.1 |
| 6 | 12.5 |
| 7 | 41.7 |
| 8 | 25.4 |

Examples 1-8 contain the functionalised polymers of the invention and they all exhibit a lower percentage water spray-off than the control grease (C1) with no polymer present.

Test 2

The ASTM D1264 test measures the water washout characteristics of greases. A tared bearing is packed with about 4 g of grease and inserted into the apparatus described in ASTM D1264. A minimum of about 750 ml of distilled water preheated to about 79° C. is added to the reservoir, but the water level is below the bearing. The water is recirculated with a water pump and reheat to the about 79° C. When the water reaches about 79° C. the water is sprayed at a rate of about 5 ml $s^{-1}$ over the bearing. The bearing is rotated at a speed of about 600 rpm for about 1 hour. The bearing is removed from the apparatus and dried for about 15 hours at about 77° C. The remaining grease is reweighed. The results obtained for the grease compositions are shown in Table 3 below.

TABLE 3

| ASTM D1264 Results | |
|---|---|
| Example | % Grease Removed by Water Washout |
| C1 | 10.86 |
| 1 | 4.1 |
| 2 | 10.2 |
| 3 | 3.5 |
| 4 | 5.1 |
| 5 | 6.0 |
| 6 | 5.0 |
| 7 | 4.84 |
| 8 | 6.1 |

Examples 1-8 shown in Table 2 contain the functionalised polymers of the invention and they all exhibit a lower percentage water washout than the control grease (C1) with no polymer present.

In summary the tests illustrate that the functionalised polymer of the invention provides grease compositions with improved water washout and spray-off properties. These enhanced properties will further provide improved longevity of the grease.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A grease composition comprising:

(a) A polymer comprising:

(i) about 25 wt % to about 90 wt % of the polymer of at least one unsaturated α,β-carboxylic acid ester containing an alkyl group having about 10 to about 20 carbon atoms;

(ii) about 5 wt % to about 65 wt % of the polymer of at least one unsaturated α,β-carboxylic acid ester containing an alkyl group having about 4 to about 11 carbon atoms different from monomer (i);

(iii) about 0.25 wt % to about 5 wt % of the polymer of at least one unsaturated dicarboxylic acid anhydride or derivatives thereof; and (iv) at least one unsaturated α,β-carboxylic acid ester containing an alkyl group having about 1 to about 3 carbon atoms present in the range from about 0 to about 9.9 wt % of the polymer composition, wherein the polymer is free of non-monomeric amine with primary functionality, secondary functionality or mixtures thereof (b) other performance additives present in the range from about 0 to about 20 wt % of the composition;

(c) at least one thickening agent; and (d) an oil of lubricating viscosity resulting in a grease composition with water wash off properties.

2. The composition of claim 1, wherein the polymer further comprises at least one unsaturated α,β-carboxylic acid ester containing an alkyl group having about 1 to about 3 carbon atoms.

3. The composition of claim 1, wherein the polymer has a molecular weight ($M_w$) in the range from about 1000 to about 1,000,000.

4. The composition of claim 1, wherein the unsaturated α,β-carboxylic acid ester containing an alkyl group having about 10 to about 20 carbon atoms is represented by the formula:

(I)

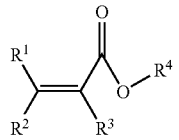

wherein, $R^1$ and $R^2$ are independently hydrogen, hydrocarbyl groups, or mixtures thereof; $R^3$ is hydrogen, methyl or mixtures thereof; and $R^4$ is derived from alkyl groups having about 10 to about 20 carbon atoms.

5. The composition of claim 1, wherein the unsaturated α,β-carboxylic acid ester containing an alkyl group having about 4 to about 11 carbon atoms is represented by the formula:

(II)

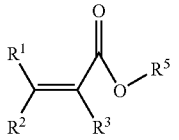

wherein, $R^1$ and $R^2$ are independently hydrogen, hydrocarbyl groups, or mixtures thereof; $R^3$ is hydrogen, methyl or mixtures thereof; and $R^5$ is derived from alkyl groups having about 4 to about 11 carbon atoms provided that $R^5$ is different from $R^4$.

6. The composition of claim 1, wherein the unsaturated α,β-carboxylic acid ester containing an alkyl group having about 1 to about 3 carbon atoms is represented by the formula:

(III)

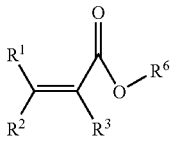

wherein, $R^1$ and $R^2$ are independently hydrogen, hydrocarbyl groups, or mixtures thereof; $R^3$ is hydrogen, methyl or mixtures thereof; and $R^6$ is derived from alkyl groups having about 1 to about 3 carbon atoms.

7. The composition of claim 1, wherein the unsaturated dicarboxylic acid anhydride or derivatives thereof functionality suitable is represented by the formula:

(IV)

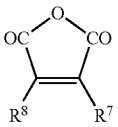

wherein $R^7$ and $R^8$ can be independently hydrogen or hydrocarbyl groups containing about 1 to about 40 carbon atoms.

8. The composition claim 7, wherein the monomer is selected from the group consisting of maleic anhydride or derivatives thereof of anhydrides, esters, acids, salts and mixtures thereof.

9. The composition of claim 1, wherein the thickener is selected from the group consisting of clay, calcite, silica, a metal salt of a monocarboxylic acid, a metal salt of dicarboxylic acid, a fatty acid containing an alkyl group and mixtures thereof.

10. The composition of claim 1, wherein the other performance additives are selected from the group consisting of antioxidants, rust inhibitors, metal deactivators, antiwear agents, antiscuffing agents, extreme pressure agents, foam inhibitors, demulsifiers, friction modifiers, viscosity modifiers, pour point depressants and mixtures thereof.

11. The composition of claim 1, wherein (i) at least one unsaturated α,β-carboxylic acid ester containing an alkyl group with about 10 to about 20 carbon atoms is present in the range from about 9.9 wt % to about 99 wt %; wherein (ii) at least one unsaturated α,β-carboxylic acid ester containing an alkyl group having about 4 to about 11 carbon atoms different from monomer (i) is present in the range from about 0.1 wt % to about 80 wt %; wherein (iii) at least one monomer with an unsaturated dicarboxylic acid anhydride or derivatives thereof is present in the range from about 0.1 wt % to about 10 wt %; and wherein (iv) at least one unsaturated α,β-carboxylic acid ester containing an alkyl group having about 1 to about 3 carbon atoms is present in the range from about 0 to about 9.9 wt % of the polymer composition.

12. The composition of claim 1, wherein the polymer is present in the range from about 0.01 wt % to about 30 wt %; wherein the thickener is present in the range from about 3 wt % to about 30 wt %; wherein the performance additives are present from about 0 wt % to about 20 wt %; and wherein the oil of lubricating viscosity is present in the range from about 20 wt % to about 97 wt % of the composition.

13. A grease composition of claim 1, wherein said grease composition has at least one improved property selected from the group consisting of improved water repellence, improved water wash-off, improved thickening, increased longevity, decreased wear and mixtures thereof.

14. A grease composition comprising:

(a) A polymer consisting essentially of:

(i) at least one unsaturated α,β-carboxylic acid ester containing an alkyl group having about 10 to about 20 carbon atoms;

(ii) at least one unsaturated α,β-carboxylic acid ester containing an alkyl group having about 4 to about 11 carbon atoms different from monomer (i);

(iii) at least one unsaturated dicarboxylic acid anhydride or derivatives thereof; and (iv) at least one unsaturated α,β-carboxylic acid ester containing an alkyl group having about 1 to about 3 carbon atoms present in the range from about 0 to about 9.9 wt % of the polymer composition, wherein the polymer is free of non-monomeric amine with primary functionality, secondary functionality or mixtures thereof;

(b) other performance additives present in the range from about 0 to about 20 wt % of the composition;

(c) at least one thickening agent; and (d) an oil of lubricating viscosity resulting in a grease composition with water wash off properties.

15. A method of using a grease comprising providing to the grease water wash-off properties by supplying the grease with a composition comprising:

(a) A polymer comprising:

(i) about 25 wt % to about 90 wt % of the polymer of at least one unsaturated α,β-carboxylic acid ester containing an alkyl group having about 10 to about 20 carbon atoms;

(ii) about 5 wt % to about 65 wt % of the polymer of at least one unsaturated α,β-carboxylic acid ester containing an alkyl group having about 4 to about 11 carbon atoms different from monomer (i);

(iii) about 0.25 wt % to about 5 wt % of the polymer of at least one unsaturated dicarboxylic acid anhydride or derivatives thereof; and (iv) at least one unsaturated α,β-carboxylic acid ester containing an alkyl group having about 1 to about 3 carbon atoms present in the range from about 0 to about 9.9 wt % of the polymer composition, wherein the polymer is free of non-monomeric amine with primary functionality, secondary functionality or mixtures thereof;

(b) other performance additives present in the range from about 0 to about 20 wt % of the composition;

(c) at least one thickening agent; and (d) an oil of lubricating viscosity resulting in a grease composition.

* * * * *